US006499916B2

(12) United States Patent
Marianski et al.

(10) Patent No.: US 6,499,916 B2
(45) Date of Patent: Dec. 31, 2002

(54) COMPRESSIBLE SUPPORT COLUMN

(75) Inventors: James E. Marianski, Bristol, TN (US); Andrew J. Marianski, Baden, PA (US)

(73) Assignee: American Commercial Inc., Bristol, VA (US)

( * ) Notice: Subject to any disclaimer, the term of this patent is extended or adjusted under 35 U.S.C. 154(b) by 0 days.

(21) Appl. No.: 09/859,222

(22) Filed: May 16, 2001

(65) Prior Publication Data

US 2001/0055517 A1 Dec. 27, 2001

Related U.S. Application Data

(63) Continuation-in-part of application No. 09/292,054, filed on Apr. 14, 1999.

(51) Int. Cl.[7] ..... E21D 15/16

(52) U.S. Cl. ..... 405/288; 405/252.1; 248/354.3

(58) Field of Search ..... 405/252.1, 272, 405/288; 248/351, 357, 354.1, 354.3; 403/109.4, 109.5, 350; 411/366.1, 367, 414

(56) References Cited

U.S. PATENT DOCUMENTS

| | | | | | |
|---|---|---|---|---|---|
| 1,234,606 | A | * | 7/1917 | Benedict | 254/103 |
| 2,548,844 | A | | 4/1951 | Myers | 254/98 |
| 3,682,345 | A | * | 8/1972 | Baugh | 215/43 R |
| 4,052,029 | A | | 10/1977 | Townsend | 248/356 |
| 4,520,980 | A | | 6/1985 | Townsend | 248/351 |
| 4,540,314 | A | * | 9/1985 | Falkner, Jr. | 114/265 |
| 4,630,761 | A | * | 12/1986 | Thomson | 215/329 |
| 5,400,994 | A | | 3/1995 | Shawwaf et al. | 248/354.3 |
| 5,413,436 | A | | 5/1995 | Merz | 405/290 |
| 5,427,476 | A | | 6/1995 | Pienaar et al. | 405/288 |
| 5,538,364 | A | | 7/1996 | Huntsman | 405/288 |
| 5,564,867 | A | | 10/1996 | Domanski et al. | 405/290 |
| 5,658,099 | A | | 8/1997 | Pienaar et al. | 405/288 |
| 5,868,527 | A | | 2/1999 | King et al. | 405/290 |

FOREIGN PATENT DOCUMENTS

| | | |
|---|---|---|
| GB | 244654 | 12/1925 |
| GB | 2149440 | 6/1985 |

OTHER PUBLICATIONS

Strata Products® (USA) Inc., Advertisement for Propsetter® Yieldable Support System, 2 pp., 1998.
DSI USA, Inc., Advertisement for Coal Post™ The Yieldable Roof Support System, 2 pp., Jan. 1999.
Heintzmann Corporation, Advertisement for Super Prop, 2 pp., Sep. 1993.

* cited by examiner

*Primary Examiner*—Anthony Knight
*Assistant Examiner*—John Kreck
(74) *Attorney, Agent, or Firm*—Webb Ziesenheim Logsdon Orkin & Henson, P.C.

(57) ABSTRACT

A compressible support used to support mine roofs. The compressible support generally includes a male member which adjustably engages a collar and may further include a cap and a wooden base. A post may also be provided. The male member defines ridges and grooves and the collar defines corrugations, each preferably in the form of modified buttress threads, which yield, fracture, or strip when the compressible support is subjected to additional force, decreasing the overall length of the compressible support.

15 Claims, 8 Drawing Sheets

COMPRESSIBLE SUPPORT COLUMN

CROSS-REFERENCE TO RELATED APPLICATION

This application is a continuation-in-part of U.S. patent application Ser. No. 09/292,054, filed Apr. 14, 1999, and entitled "Compressible Support Column."

BACKGROUND OF THE INVENTION

1. Field of the Invention

The present invention relates to compressible supports for mine roofs and the like. More specifically, the present invention relates to vertical support columns having compressible supports.

2. Brief Description of the Prior Art

Support columns are used to counteract the force that gravity exerts on the mass of an object. For example, vertical support columns are positioned between two horizontal objects to keep the objects spaced away from one another.

In underground mining, vertical support columns are used as primary or secondary supports for mine roofs. Due to the tremendous forces exerted on the vertical support columns by the earth and rock above the mine roof, including forces resulting from shifting and settling of the overhead earth and rock, rigid vertical support columns can bend or break. Complete failure of a vertical support column can cause an isolated collapse of the mine roof. Therefore, compressible support columns, which yield during settling or shifting of the mine roof, are often used.

In mining operations, compressible vertical support columns are generally positioned perpendicularly between a mine roof and a mine floor. One type of compressible support column is disclosed in U.S. Pat. No. 4,052,029 to Townsend. The Townsend patent uses telescoping members and compressible materials to reduce the overall length of the support column as the earth and rock above the mine roof settles or shifts. Specifically, the Townsend patent discloses a support column having a hollow lower steel member and a hollow upper steel member, where the upper steel member fits over and slideably telescopes toward the lower steel member. The hollow cavity within the lower steel member is completely filled with wood positioned with the grain of the wood oriented parallel to a vertical axis of the assembled column. The hollow cavity in the upper steel member is only partially filled with wood, with the grain of the wood also aligned with the vertical axis of the assembled column. The space left between the wood in the upper and lower steel members is filled with discs, as needed, to adjust the length of the assembled compressible support column between a mine roof and a mine floor.

When earth and rock above the compressible support column disclosed in the Townsend patent shift, settle, or are otherwise subjected to additional force, the wood inside of the upper and lower steel members compresses. The compression reduces the overall length of the assembled compressible support column, easing the force being exerted on the column. Additional settling or shifting of the mine roof further compresses the load resisting material, until the lower steel member is telescoped to its full extent inside of the upper steel member. At this point, the upper and lower steel columns begin to compress, causing the upper and lower steel members to bulge outwardly, away from the vertical axis of the assembled upper and lower steel columns.

One disadvantage of the prior art compressible support columns is that they are expensive to make. Another disadvantage is that adjusting the length of the columns during installation is time consuming. Therefore, one object of the present invention is to provide a column having a compressible support that is inexpensive to manufacture. Another object of the present invention is to make a column having a compressible support that can be installed quickly.

SUMMARY OF THE INVENTION

The present invention generally includes a compressible support which includes a male member defining a plurality of ridges and grooves and a collar which has an internal surface defining a plurality of corrugations. The corrugations adjustably engaging grooves defined by the male member, the ridges defined by the male member, and the corrugations defined by the collar yield when the male member and collar are compressed together One embodiment of the present invention generally includes a post and a collar. A cap and a base may also be provided. The post has a first end, a second end, and a longitudinal axis. The post also includes ridges and grooves, generally in the form of threads, positioned adjacent the first end of the post.

The collar has a first end, a second end, an internal surface, and an external surface. The second end of the collar is positioned adjacent the first end of the post during installation. Corrugations made from a material harder than the ridges and grooves of the post are positioned adjacent the internal surface of the collar. The corrugations adjustably engaging the ridges and grooves of the post, which are generally in the form of threads, are adjacent the first end of the post. The corrugations and threads allow the collar to be adjustable along a longitudinal axis of the post, essentially by threading the collar onto or off of the first end of the post. An optional cap and an optional base may be positioned adjacent the ends of the post and collar to distribute the force applied to the post and collar over a greater surface area.

When an initial or preloading force is exerted on the male member or post and the collar, referred to hereafter as the compressible support, the compressible support provides an equal and opposite force. As the force on the compressible support increases, the ridges positioned adjacent to the first end of the male member crush, yield, fracture, or strip, allowing the collar to move toward the second end of the male member, decreasing the overall length of the compressible support. Additional force causes additional crushing of the grooves adjacent the first end of the male member, until the movement of the collar toward the second end of the male member is arrested. At this point, further force causes the first end of the male member and the collar to compress, further decreasing the overall length of the compressible support.

Another embodiment of a compressible support according to the present invention generally includes a male member, a collar, and a post. In this embodiment, the male member is separate from the post.

These and other advantages of the present invention will be clarified in the description of the preferred embodiments taken together with the attached drawings in which like reference numerals represent like elements throughout.

DETAILED DESCRIPTION OF THE PREFERRED EMBODIMENTS

Figure 1:
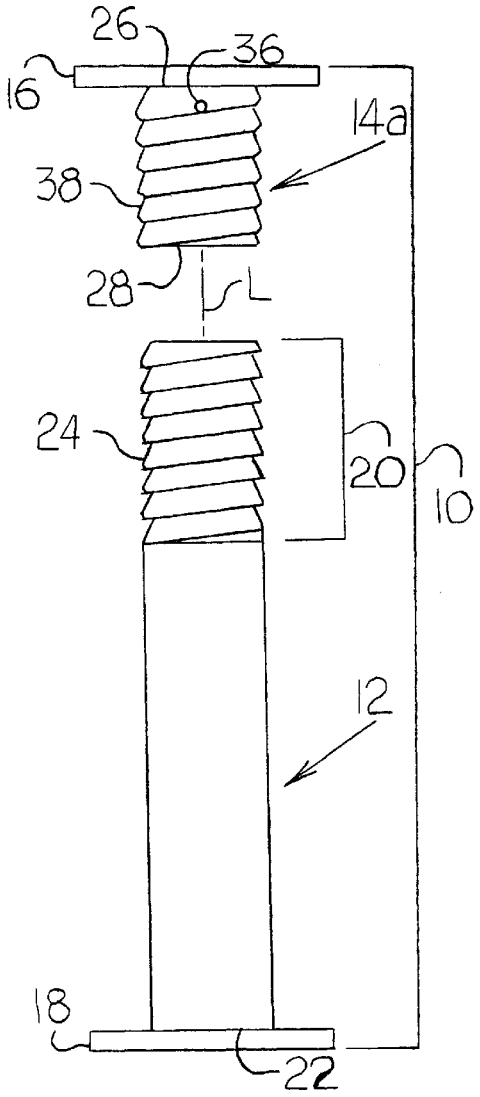
FIG. 1 is an exploded side view of a compressible support according to a first embodiment of the present invention.
Figure 3:
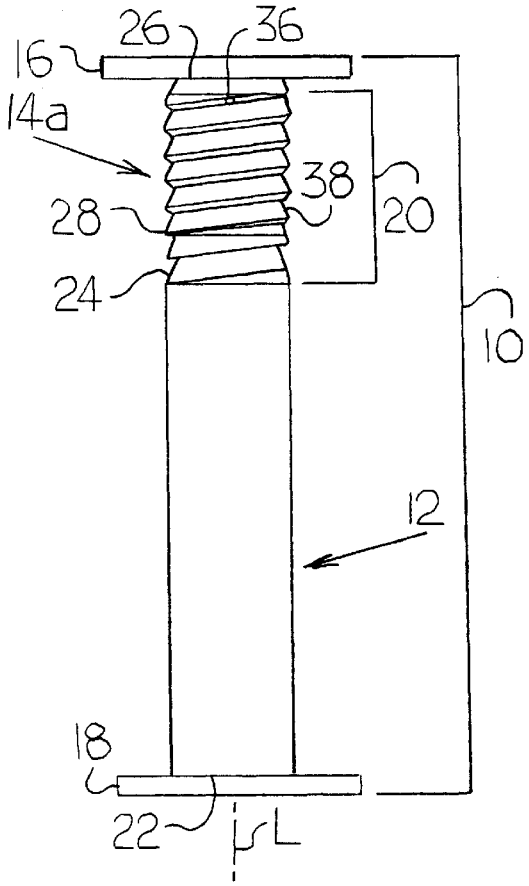
FIG. 3 is a side view of the compressible support shown in FIG. 1, with a collar adjustably attached to a first end of a male member thereof.
Figure 2:
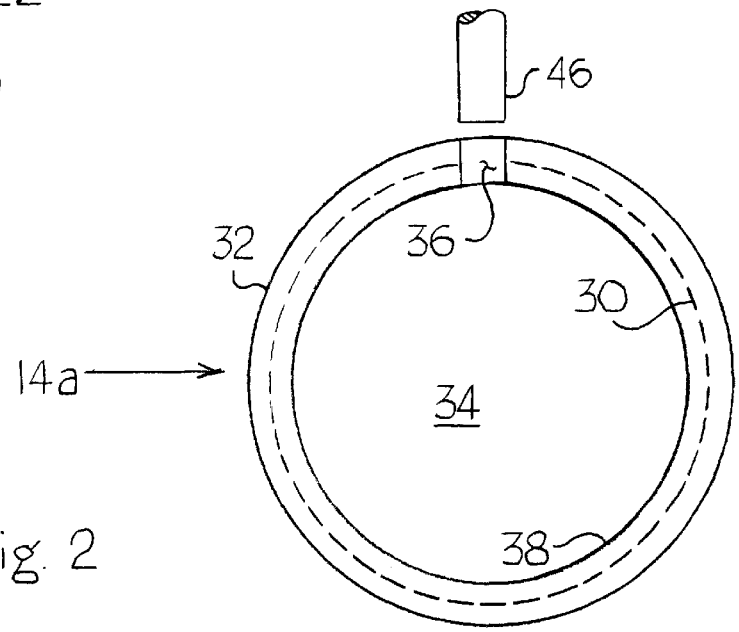
FIG. 2 is a bottom view of a collar shown in FIG. 1.

FIGS. 1–6 generally show a first embodiment compressible support 10 according to the present invention. As shown in FIGS. 1 and 3–6, the compressible support 10 generally includes a male member 12, a collar 14A, a cap 16, and a base 18. In this first embodiment, the male member 12 is preferably a post having a first end 20, a second end 22, a longitudinal axis L, and ridges and grooves forming threads 24. The collar 14A has a first end 26 and a second end 28, and as shown in FIG. 2, an internal surface 30, an external surface 32, with the internal surface 30 forming an internal cavity 34. With reference to FIGS. 1 and 2, the internal surface 30 has adjacently positioned corrugations 38 that adjustably engage the threads 24 positioned adjacent the first end 20 of the male member 12. The external surface 32 may also form a lever cavity 36 for receiving a lever 46.

The male member 12 or post is preferably made from hardwood, such as poplar, oak, or other material capable of supporting an applied force of 50 to 100 tons parallel to the longitudinal axis L of the male member 12. The male member 12 is preferably one piece, but may also be a combination of different pieces and different materials. Moreover, the male member 12 can be made into any shape which permits the threads 24 adjacent the first end 20 of the male member 12 to adjustably engage the corrugations 38 adjacent the internal surface 30 of the collar 14A. However, a cylindrical-shaped post 12 with a ten inch diameter is preferred.

The threads 24 positioned adjacent to the first end 20 of the male member 12 preferably extend six to eighteen inches from the first end 20 of the male member 12 toward the second end 22 of the male member 12, along the longitudinal axis L. The threads 24 are made from a material softer than the corrugations 38 positioned adjacent to the internal surface 30 of the collar 14A. Generally, the threads 24 are made from the same material as the male member 12, but the threads 24 may also be formed from a material different from the male member 12.

Figure 8:
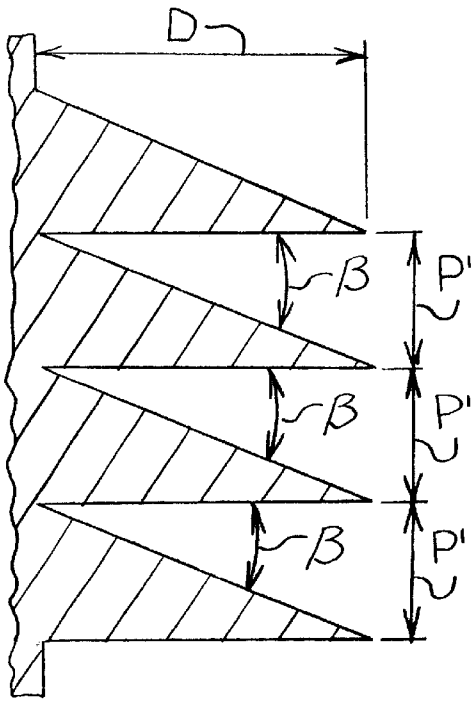
FIG. 8 is a cross-sectional side view of modified buttress threads.
Figure 7:
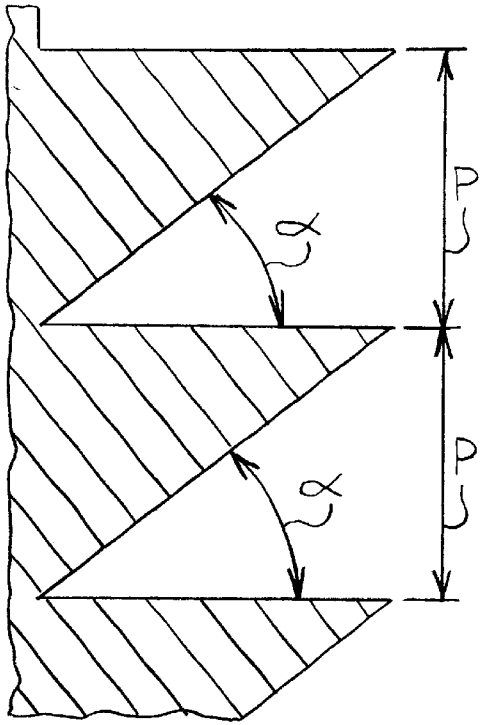
FIG. 7 is a cross-sectional side view of standard buttress threads.
Figure 9:
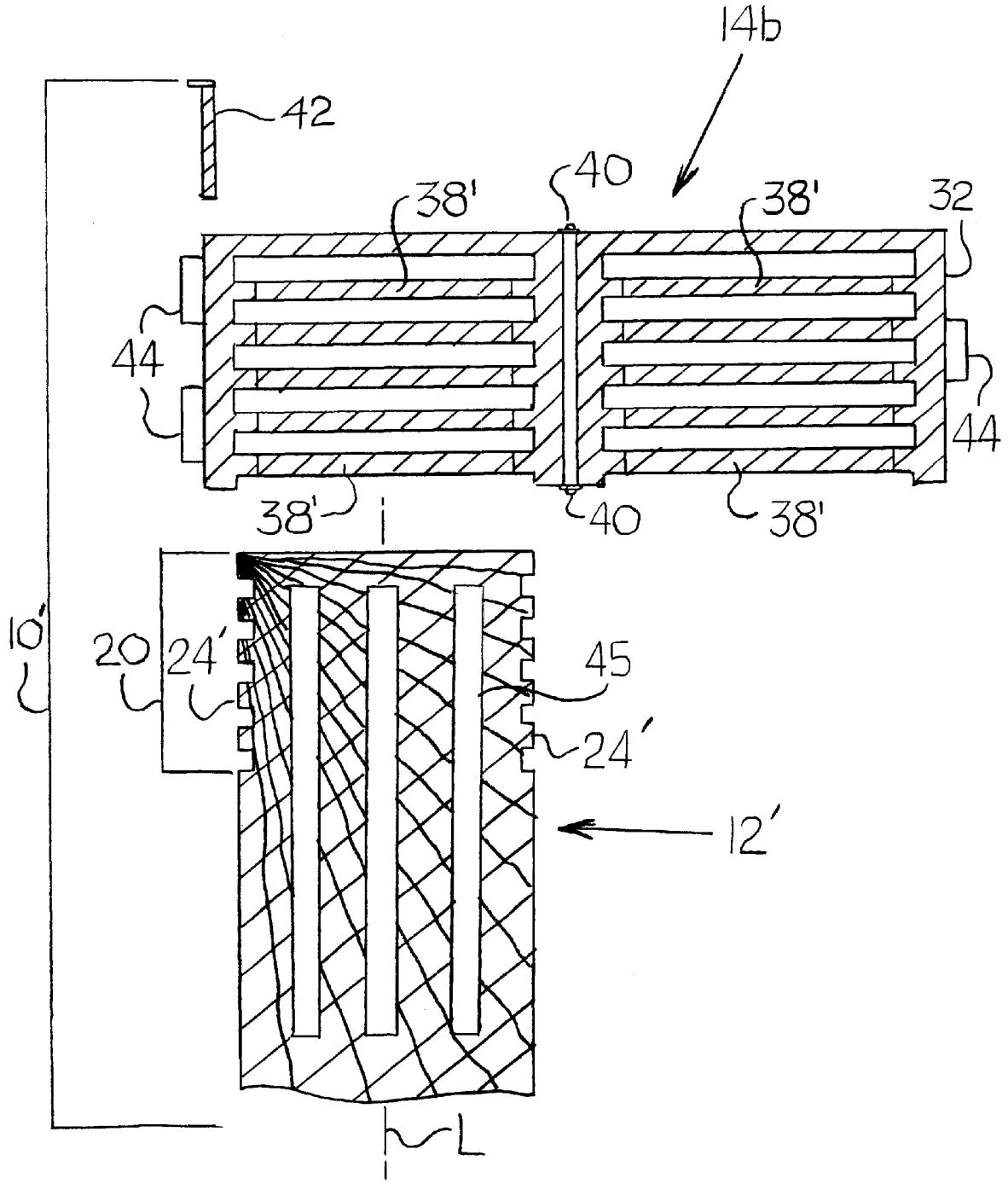
FIG. 9 is a side view of a compressible support according to a second embodiment of the present invention.

The threads 24 are preferably modified buttress threads made from a hardwood, such as poplar. A buttress thread is normally designed to take exceptionally high stresses in one direction (i.e., on the load resisting or flank-vertical side). An example of a typical buttress thread is shown in FIG. 7. To make a modified buttress thread and utilize the buttress principal as a yielding element, the loading is reversed and one of the threads 24 is cut into a material which will yield. For this type of application, as shown in FIGS. 7 and 8, the buttress angle $\alpha$ of a standard buttress thread is reduced from a conventional forty-five to fifty degree angle to an angle $\beta$ between fifteen and thirty degrees. The pitch P of the modified buttress threads is also modified, preferably resulting in threads 24 having a two inch pitch P' and a one inch depth D. It is understood that decreasing the buttress angle reduces the load-resisting properties of the threads 24. In addition, while modified buttress threads 24 having buttress angles $\beta$ of fifteen to thirty degrees are preferred, other types of ridge and groove configurations, including other types of yieldable threads, are also suitable. For example, FIG. 9 shows a second embodiment compressible support 10' having a male member 12' defining threads 24' which are not connected to each other.

Figure 10:
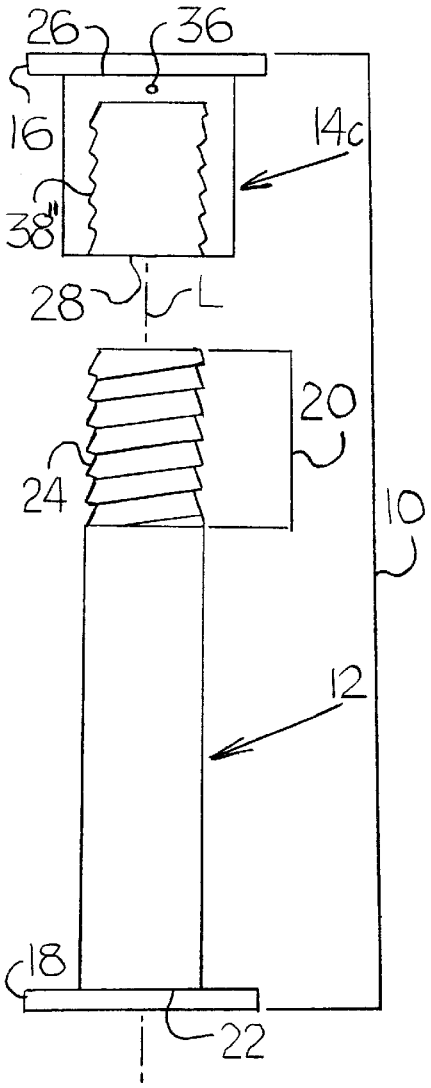
FIG. 10 is an exploded side view of the male member shown in FIGS. 1–8 with another type of collar adjustably attached to the first end of the male member thereof.
Figure 11:
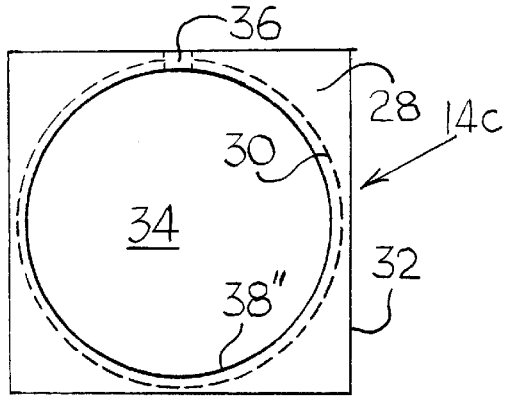
FIG. 11 is an end view of the collar shown in FIG. 10.
Figure 12:
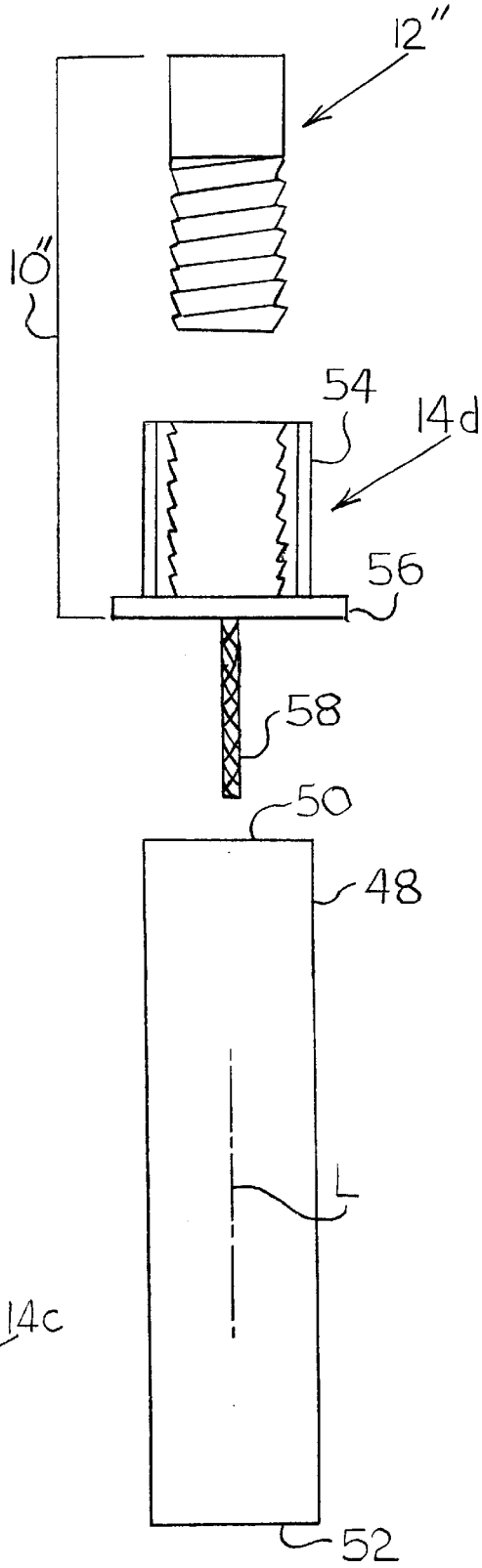
FIG. 12 is an exploded side view of a compressible support according to a third embodiment of the present invention.

With reference to FIGS. 1 and 3–6, the collar 4A is preferably made from a harder material than the male member 12 threads 24, such as a harder wood, metal, or any other suitable material or combination thereof. The collar 14A is preferably a one-piece section extending the same distance as the threads 24 positioned adjacent the first end 20 of the male member 12. However, FIG. 9 shows a second embodiment compressible support 10' having a collar 14B with two or more pieces connected to one another by pivot joints 40 or secured with flanges 44 and pin 42. Moreover, as shown in FIGS. 10–11, reinforced collars 14C may also be used. Different collar lengths are also contemplated.

With reference to FIGS. 1–6 and 9–11, the corrugations 38, 38', 38", like the collar 14A–14C, are preferably made from materials that are harder than the material used to make the threads 24, 24' positioned adjacent to the first end 20 of the male member 12, 12'. As shown in FIGS. 1–6 and 10–11, the corrugations 38, 38" positioned adjacent to the internal surface 30 of the collar 14A, 14C preferably form modified buttress-type threads 24 that adjustably engage the modified buttress threads 24 positioned adjacent the first end 20 of the male member 12. Moreover, while the corrugations 38, 38', 38" are preferably formed by the internal surface 30 of the collar 14A–14C, the corrugations 38, 38', 38" may also be formed by welding seams or by inserting a pipe segment or other device adjacent the internal surface 30 of the collar 14A–14C.

Referring to FIG. 1, a cap 16 and a base 18 may be added to the collar 14A and post 12, respectively, to help distribute an applied force over a greater area. The cap 16 has a planar shape and is positioned adjacent the first end 26 of the collar 14A, perpendicular to the longitudinal axis L of the post 12. The base 18 also has a planar shape and is positioned adjacent the second end 22 of the post 12, perpendicular to the longitudinal axis L of the post 12 and parallel to the cap 16.

Figure 4:
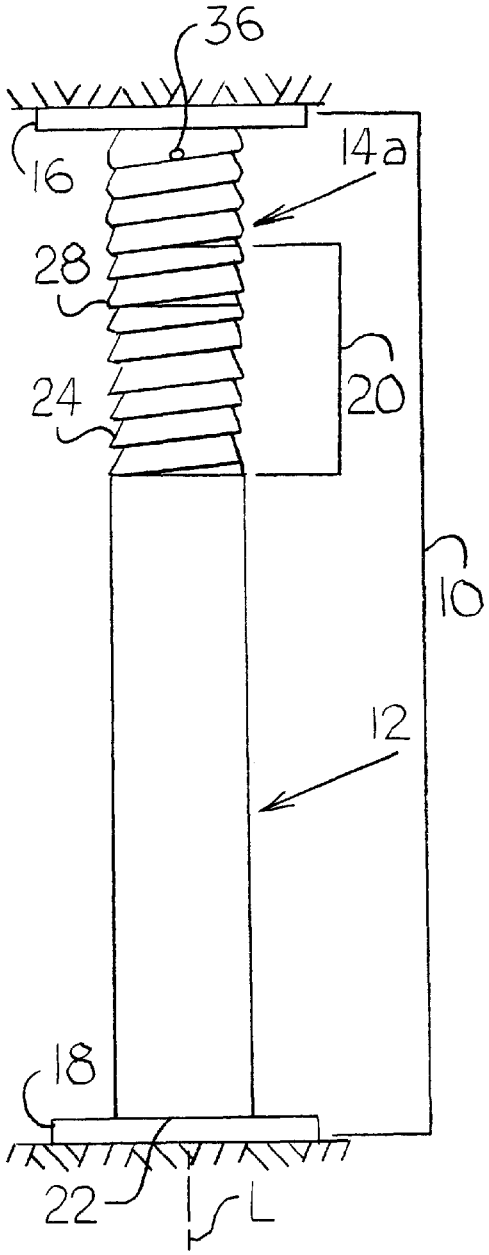
FIG. 4 is a side view of the compressible support shown in FIGS. 1 and 3, with the collar adjustably extended away from a second end of the male member.
Figure 5:
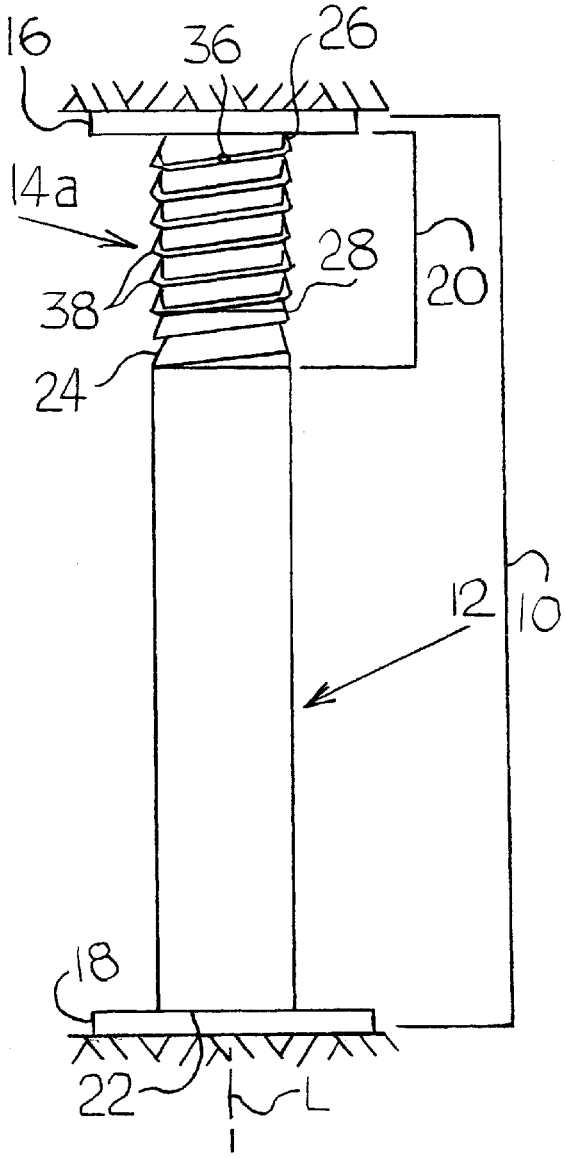
FIG. 5 is a side view of a compressible support with threads attached to the first end of the male member fractured.
Figure 6:
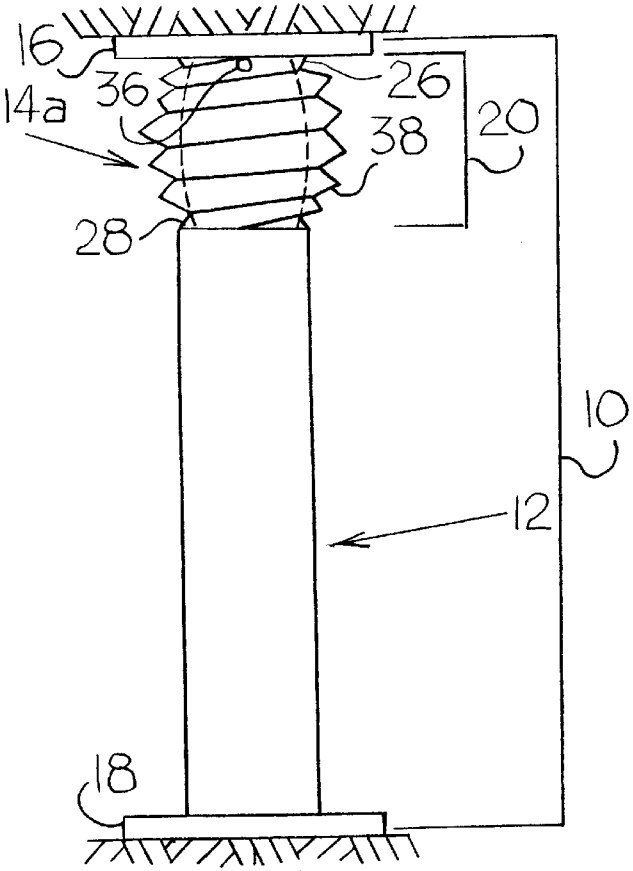
FIG. 6 is a side view of the compressible support shown in FIG. 5, where the first end of the male member and the collar are compressed.

One example of operation is shown in FIGS. 4–6. As shown in FIG. 4, the compressible support 10, formed by adjustably engaging the collar 14A to the first end 20 of the male member 12, is inserted perpendicularly between two objects, such as a mine roof and a mine floor. The compressible support 10 length is varied by adjusting the collar 14A. If the male member 12 and collar 14A have threads 24, the length of the compressible support 10 is adjusted by turning the collar 14A and then moving the collar 14A along the longitudinal axis L of the male member 12. Turn lever 46 (FIG. 2) may be inserted into the lever cavity 36 in the collar 14A and rotated about the longitudinal axis L of the male member 12 to aid in adjustment. As shown in FIG. 9, the male member 12' and collar 14B have a different configuration, such as corrugations 38' and ridges and grooves 24' in place of threads 24. In this embodiment, the collar 14B is positioned adjacent the first end 20 of the male member 12' and is adjusted by moving the collar 14B toward or away from the second end 22 of the male member 12', along the longitudinal axis L of the male member 12'.

Referring again to FIG. 5, when an initial or preloading force is exerted on the compressible support 10, the compressible support 10 provides an equal and opposite force. As the force on the compressible support 10 increases, the threads 24 adjacent the first end 20 of the male member 12 yield, crush, or strip, allowing the collar 14A to move toward the second end 22 of the male member 12, and decreasing the overall length of the compressible support 10. Further force causes additional yielding, crushing, or stripping of the threads 24 adjacent the first end 20 of the male member 12, until the movement of the collar 14A toward the second end 22 of the male member 12 is arrested. At this point, as shown in FIG. 6, still further force causes the first end 20 of the male member 12 to compress, further decreasing the overall length of the compressible support 10, and causing the first end 20 of the male member 12, as well as the collar 14A, to bulge outwardly away from a longitudinal axis L of the male member 12. This effect can be encouraged by hollowing or cutting slits 45 (shown in phantom in FIG. 9) into the first end 20 of the male member 12.

As shown generally in FIGS. 12–20, a third embodiment compressible support 10" generally includes a male member 12", a collar 14D, a cap 16, and a base 18. A post 48 is also provided in addition to the male member 12". The third embodiment compressible support 10" includes some elements previously discussed in connection with the first and second embodiments, with like reference numerals indicating like parts.

Figure 13:
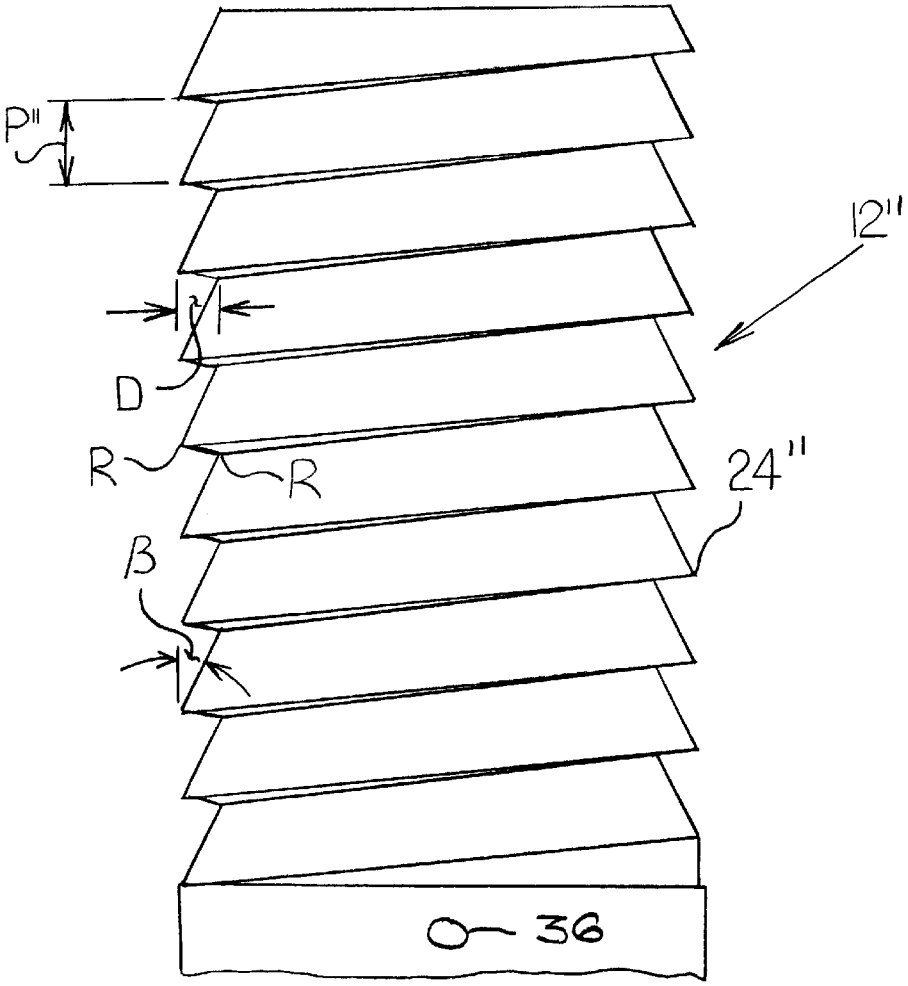
FIG. 13 is a side view of a male member shown in FIG. 12.

As shown in FIG. 13, the male member 12" has an outer surface which defines a plurality of ridges and grooves, preferably in the form of modified buttress threads 24", and may also define a lever cavity 36. Both the male member 12" and the threads 24" are preferably made from a yieldable material, with high-density polyethylene or other suitable material being preferred. The threads do not necessarily have to extend along the entire outer surface of the male member 12".

Figure 14:
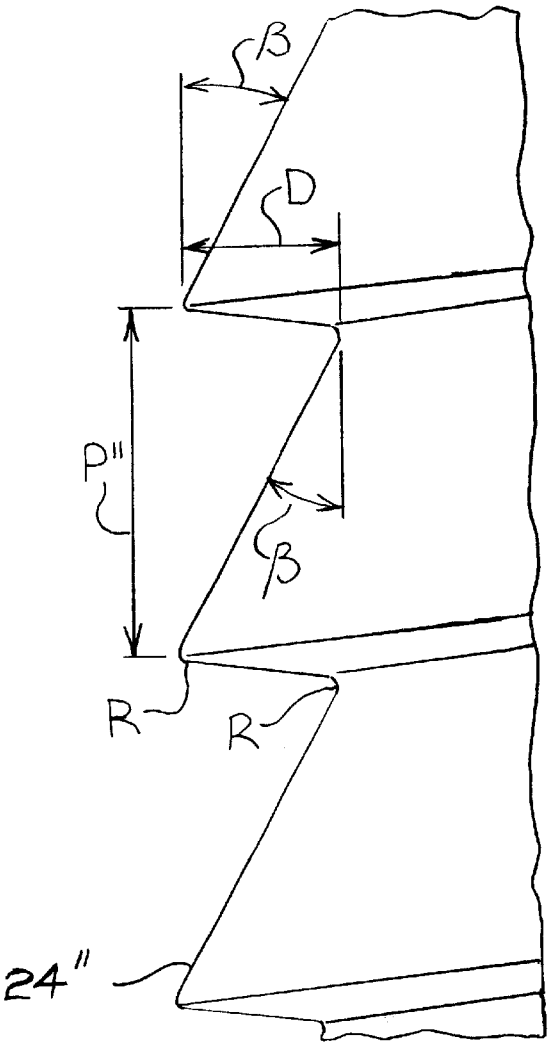
FIG. 14 is a partial cross-sectional view of the male member shown in FIG. 13.

As shown in FIG. 14, the modified buttress threads 24" preferably have a buttress angle β of approximately fifteen to thirty degrees, with a buttress angle β of approximately twenty-six to twenty-seven degrees being preferred. The threads 24" preferably have a one inch pitch P" and a 15/32 inch depth D. Each corrugation may also define a 1/32 inch radius R. As stated earlier, it is understood that decreasing the buttress angle β reduces the load resisting properties of the modified buttress thread 24" and that while modified buttress threads 24" having buttress angles β of twenty-six to twenty-seven degrees are preferred, other types of ridge and groove configurations, including other types of yieldable threads, are also suitable.

Figure 16:
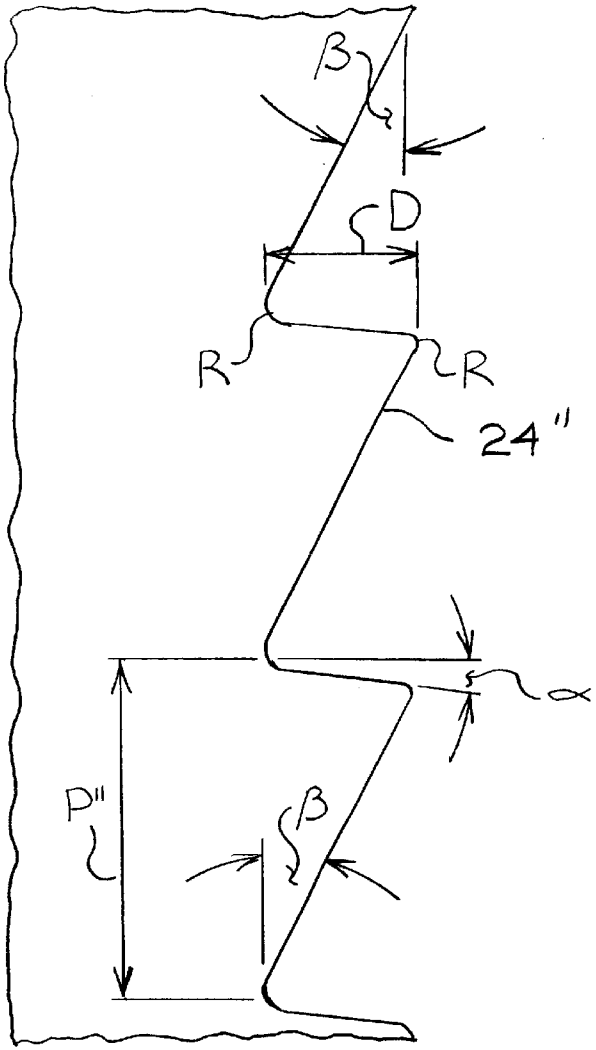
FIG. 16 is a partial cross-sectional side view of the collar shown in FIG. 15.
Figure 15:
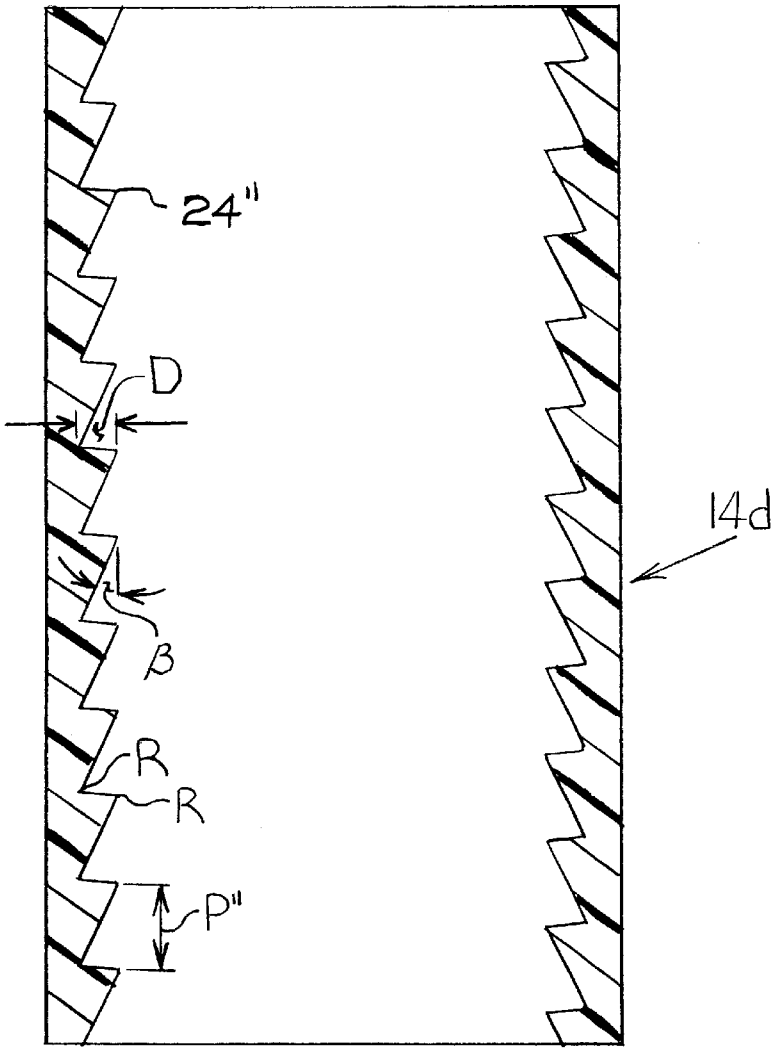
FIG. 15 is a cross-sectional side view of the collar shown in FIG. 12.
Figure 17:
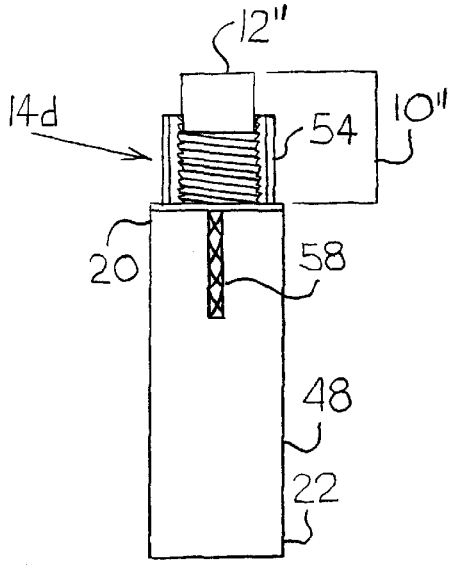
FIG. 17 is a partial cross-sectional view of the compressible support and post shown in FIG. 12.

As shown in FIGS. 15–16, the corrugations 38" defined by the collar 14D are also preferably modified buttress threads having a buttress angle β of approximately fifteen to thirty degrees, with a buttress angle β of approximately twenty-six to twenty-seven degrees being preferred. The pitch of the corrugations 38" is also modified, preferably resulting in corrugations 38" having a one inch pitch P" and a 15/32 inch depth D. Each corrugation 38" may also define a 1/32 inch radius R.

The post 48 shown in FIGS. 12 and 17–20 is preferably made from any material capable of supporting an applied force of 50 to 100 tons parallel to the longitudinal axis L of the post. The post 48 is preferably one piece, but may also be a combination of different pieces and different materials. A connection device, such as the spike 58 and plate 56 combination shown in FIGS. 12 and 17–20, may be used to attach the collar 14D to the post 48.

With continuing reference to FIGS. 12 and 17–20, a one-piece support 54 may also be positioned adjacent to the collar 14D. The support 54 is preferably made from metal, such as steel or other suitable material, and may extend the same distance as the collar 14D. To help distribute an applied force over a greater area, a cap 16 and a base 18 may also be added to the male member 12 and the post 48, respectively.

Figure 18:
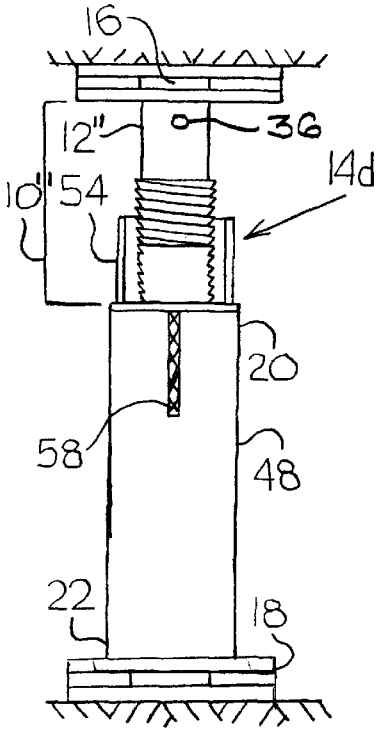
FIG. 18 is a partial cross-sectional side view of the compressible support and post shown in FIGS. 12 and 17 with a male member of the compressible support extending away from the post.
Figure 19:
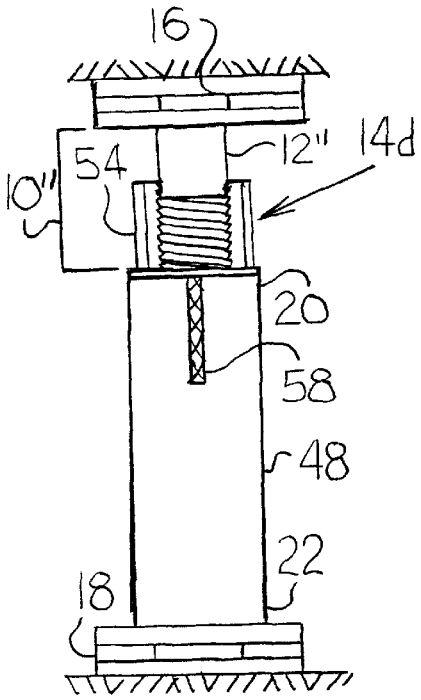
FIG. 19 is a partial cross-sectional side view of the compressible support and post shown in FIGS. 12 and 17–18 with threads defined by a male member and corrugations defined by the collar fractured.
Figure 20:
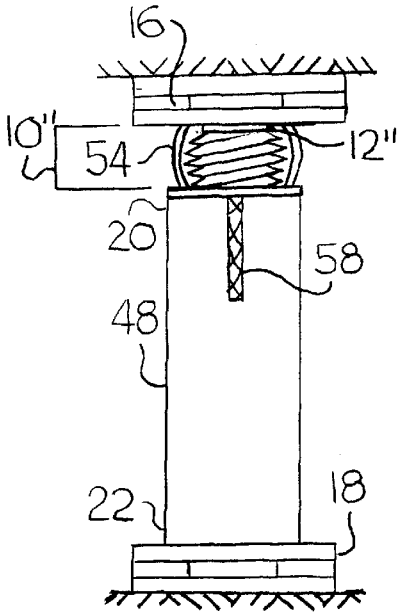
FIG. 20 is a partial cross-sectional side view of the compressible support shown in FIGS. 12 and 17–19 with the male member and collar compressed.

In operation, as shown in FIGS. 18–20, the compressible support 10" is inserted perpendicularly between two objects, such as a mine roof and a mine floor. As shown in FIG. 18, length is varied by rotating the male member 12" to screw or unscrew the male member 12" in relation to the collar 14D. A turn lever 46 (FIG. 2) may be inserted into the lever cavity 36 in the male member 12" and rotated about the longitudinal axis L of the male member 12" to aid in adjustment.

When an initial or preloading force is exerted on the compressible support 10", the compressible support 10" provides an equal and opposite force. As shown in FIG. 19, as the force on the compressible support 10" increases, the threads 24 defined by the male member 12" and the corrugations 38" defined by the collar 14D yield, crush, or strip, allowing the male member 12" to move toward the second end 22 of the post 48. Further force causes additional yielding, crushing, or stripping of the threads 24" and corrugations 38", until the movement of the male member 12" toward the second end 22 of the post 48 is arrested. At this point, as shown in FIG. 20, still further force causes the compressible support 10" to compress further, decreasing the overall length of the compressible support 10".

The third embodiment compressible support 10" of the present invention may be positioned adjacent to either end of the post 48. Moreover, any of the aforementioned embodiments 10, 10', 10" may be used for both adjustment and yield.

The invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

We claim:

1. A compressible support including:

a male member defining a plurality of modified buttress threads;

a collar which has an internal surface defining a plurality of corrugations that adjustably engage the modified buttress threads defined by the male member; and a post attached to the collar, wherein the modified buttress threads defined by the male member and the corrugations defined by the collar are specifically and intentionally designed to yield when the male member and collar are compressed together.

2. The compressible support as claimed in claim 1, wherein the modified buttress threads have a buttress angle of approximately fifteen to thirty degrees.

3. The compressible support as claimed in claim 2, wherein the modified buttress threads having a buttress angle of approximately twenty-six to twenty-seven degrees.

4. The compressible support as claimed in claim 1, wherein the male member and the collar are made from high-density polyethylene.

5. The compressible support as claimed in claim 1, further comprising a spike positioned adjacent to the collar.

6. The compressible support as claimed in claim 1, wherein the male member is a post having a first end and a second end, wherein the modified buttress threads are positioned adjacent to the first end of the post and the modified buttress threads are made from a material softer than the corrugations.

7. The compressible support as claimed in claim 6, wherein the modified buttress threads are made from hardwood selected from the group consisting of poplar and oak, and the corrugations are made from metal.

8. The compressible support as claimed in claim 6, wherein the first end of the post is structurally weakened.

9. A method of using a compressible support which includes a male member which defines a plurality of ridges and grooves and a collar which defines an internal surface and a plurality of corrugations, the corrugations adjustably engaging grooves defined by the male member, comprising the steps of:

a. inserting a compressible support between two objects spaced away from one another;

b. adjusting the compressible support so the compressible support has a support length and fits between the two objects;

c. compressing the compressible support between the two objects;

d. allowing the ridges defined by the male member and the corrugations defined by the support to yield; and e. reducing the compressible support to a length less than the support length.

10. The method as claimed in claim 9, wherein the step of adjusting the compressible support so the compressible support has a support length and fits between the two objects is accomplished by rotating the male member with respect to the collar.

11. The method as claimed in claim 9, wherein the step of adjusting the compressible support so the compressible support has a support length and fits between the two objects is accomplished by rotating the collar with respect to the male member.

12. A compressible support comprising:

a male member defining a plurality of modified buttress threads having a modified buttress angle of approximately fifteen to thirty degrees; and a collar defining a plurality of modified buttress threads having a modified buttress angle of approximately fifteen to twenty degrees, wherein the modified buttress threads defined by the male member and the modified buttress threads defined by the collar are specifically and intentionally designed to yield when the male member and collar are compressed together and the modified buttress threads defined by the male member are made from a material softer than the material used to make the modified buttress threads defined by the collar.

13. The compressible support as claimed in claim 12, wherein the male member and the collar are both made from polyethylene.

14. The compressible support as claimed in claim 12, further comprising a cap positioned adjacent to the collar.

15. The compressible support as claimed in claim 12, further comprising a post attached to the collar.

* * * * *